US006146267A

United States Patent [19]

Beudon et al.

[11] Patent Number: 6,146,267

[45] Date of Patent: Nov. 14, 2000

[54] DEVICE FOR SEPARATING TWO ZONES WITH DIFFERENT ENVIRONMENT

[75] Inventors: Didier Beudon, Rambouillet; Pierre Bridenne, Forges-les-Bains, both of France

[73] Assignee: U.N.I.R. Ultra Propre-Nutrition Industrie-Recherche, Paris, France

[21] Appl. No.: 09/380,479

[22] PCT Filed: Feb. 27, 1998

[86] PCT No.: PCT/FR98/00388

§ 371 Date: Oct. 19, 1999

§ 102(e) Date: Oct. 19, 1999

[87] PCT Pub. No.: WO98/39604

PCT Pub. Date: Sep. 11, 1998

[30] Foreign Application Priority Data

Mar. 3, 1997 [FR] France ..... 97 02486

[51] Int. Cl.[7] ..... F24F 9/00

[52] U.S. Cl. ..... 454/188; 454/190

[58] Field of Search ..... 454/187, 188, 454/190, 193

[56] References Cited

U.S. PATENT DOCUMENTS

| | | | |
|---|---|---|---|
| 3,143,952 | 8/1964 | Simons | 454/190 |
| 4,009,647 | 3/1977 | Howorth | 454/190 |
| 4,534,277 | 8/1985 | Gilmor | 454/188 |
| 4,700,688 | 10/1987 | Seacy et al. | 454/188 |
| 5,306,209 | 4/1994 | Lang | 454/188 |
| 5,413,529 | 5/1995 | Aragon | 454/187 |
| 5,934,992 | 8/1999 | Sohier | 454/190 |

FOREIGN PATENT DOCUMENTS

| | | |
|---|---|---|
| 2 530 163 | 1/1984 | France . |
| 1 087 787 | 8/1960 | Germany . |
| 1 095 497 | 12/1960 | Germany . |
| 1 237 694 | 6/1971 | United Kingdom . |

*Primary Examiner*—Harold Joyce
*Assistant Examiner*—Derek S. Boles
*Attorney, Agent, or Firm*—Foley & Lardner

[57] ABSTRACT

The invention concerns a device for separating (100) a first (10) from a second zone (20) in which prevails different kinds of environment. The invention is characterised in that it comprises: a buffer zone (110) extending along a longitudinal axis X between the first and second zones, and communicating via an inlet (111) with the first zone (10), and via an outlet (112) with the second zone (20); means for injecting air (120, 120*a*) opening at the inlet of the buffer zone, for injecting on either side of said longitudinal axis X, towards the outlet of said buffer zone, two clean air jets (121, 122) at high speed, extending along oblique directions (Y1, Y2) relative to the axis X, which cross each other in a region between the inlet and the central region (113) of said buffer zone, so as to form an impassable barrier which separates the first from the second zone.

5 Claims, 4 Drawing Sheets

DEVICE FOR SEPARATING TWO ZONES WITH DIFFERENT ENVIRONMENT

Figure 1:
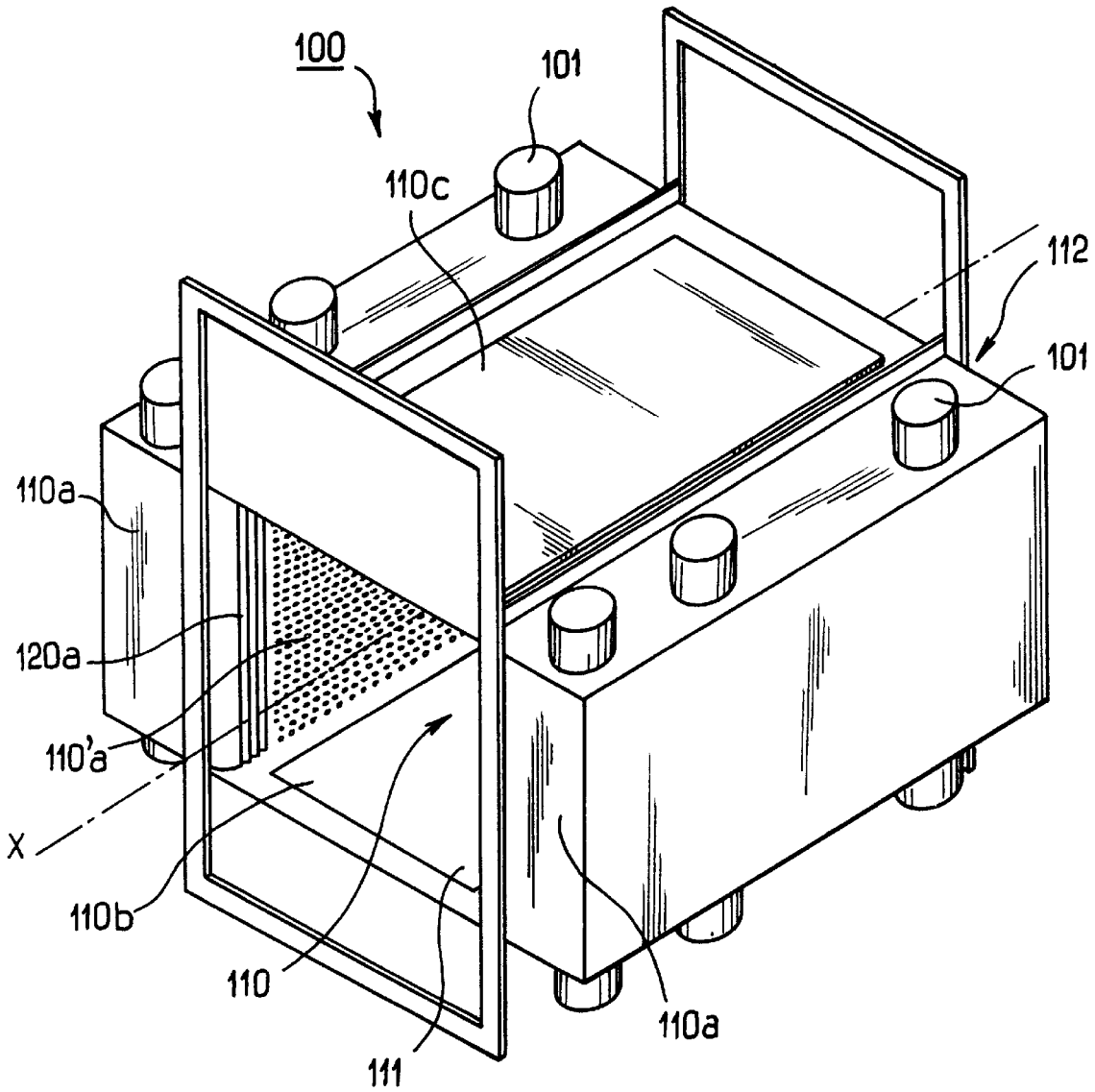

The present invention relates to a device for separating first and second zones in which different environments prevail.

The term "environment" as used here means the air conditions, gas and particulate concentrations and, in particular, the contaminants' concentrations, pressure and temperature conditions, hygrometry, etc.

The invention finds a particularly advantageous application in the industrial spheres of agro-foodstuffs, medicine, biotechnology, electronics, the nuclear industry and the chemical industry, in which spheres it is necessary to maintain different environments in zones which communicate with each other, while at the same time allowing the frequent passage of objects or products from one zone to another.

In the agro-foodstuff or pharmaceutical spheres of industry, or alternatively in a hospital environment, the issue is one of protecting clean zones in which the atmosphere is sterile from external contamination, it being possible for these zones to be at a slightly raised pressure compared with the outside, while at the same time allowing products or objects to pass from the said clean zones to the outside where there is a certain amount of ambient contamination, and vice versa, without transferring the contamination.

By contrast, in the nuclear sphere of industry, the issue is one of protecting the outside from possible contamination from a contaminated zone while at the same time also allowing objects or products to pass from the outside into the contaminated zone, and vice versa. In this instance, it is the contaminated zone which is to be confined with respect to the outside.

There are currently three known types of solution for separating two zones which communicate with each so as, for example, to allow objects in and out: protection by a mechanical airlock, protection by ventilation and projection using a curtain of air.

Protection using a mechanical airlock consists in inserting between two zones that are to be isolated from one another a zone in which the air is controlled, this zone being separated from the said zones by airtight doors which can be actuated to make them open and close.

The main drawback of such a mechanical airlock is that products or objects can be transferred from one zone to the other via the said airlock only at slow rates, because of the opening and closing of the doors to this zone.

When the zone that is to be protected contains a product likely to be contaminated by the ambient air, protection by ventilation consists in injecting, into the zone that is to be protected, a laminar flow which is blown outward through the opening via which this zone is accessed. In the reverse scenario, when the personnel and environment outside a contaminated space need to be protected, dynamic confinement is provided by employing extraction ventilation in this contaminated space. In both instances, an empirically determined formula sets a minimum air speed of the order of 0.5 m/s for the ventilated air in the plane of opening via which the two zones communicate, so as to avoid the transfer of contamination in the protected zone.

The efficacy of this technique of providing protection by ventilation is not, however, perfect, particularly in so-called "break-through" situations, that is to say situations where objects or products are transferred from one zone to another.

Furthermore, this protection solution entails treating and monitoring, as the case may be, the entire zone that is to be protected, whether this be the clean zone or the contaminated zone.

Thus, when the zone that is to be protected is very large, treating and monitoring it lead to a particularly high equipment and running cost.

Finally, this technique of providing protection by ventilation provides protection only in one direction, that is to say that it applies only when transfers of contamination can occur in just one direction.

The technique of providing protection using a curtain of air consists in injecting simultaneously, into the separation zone via which the two zones communicate, one or more adjacent jet(s) of clean air in the same direction, which form(s) an imaginary door between the zone that is to be protected and the contaminating zone.

Documents FR-A-2 530 163 and FR-A-2 652 520 propose systems which employ a curtain of air to separate a polluted zone and a clean zone. In both instances, the curtain of air is formed by two adjacent jets of clean air in the same direction. Dynamic separation is provided in this case by a first relatively slow jet of air, the cone of which covers an entire opening. The second jet, which is relatively fast compared with the slow jet, is positioned between the slow jet and the clean zone. Its function is to stabilize the slow jet by a suction effect which holds this slow jet against the fast jet.

Document FR-A 2 652 520 proposes that ventilating clean air be injected at the same time as the curtain of clean air, at a temperature determined to suit the need, into the clean zone that is to be protected. It is emphasized that this ventilating clean air is to be injected at a flow rate roughly equal to the flow rate induced by the face of the fast jet of the curtain of air, which is in contact with the ventilating clean air.

In another document—FR-A 2 659 782—it is proposed that a third, relatively slow jet of clean air be added to the two jets of clean air used in the systems described in FR-A-2 530 163 and FR-A-2 652 520, so that the fast jet finds itself between two adjacent slow jets traveling in the same direction.

In spite of the improvements made by the air curtain technique proposed in the various aforementioned documents, the problem of transferring objects or products at a high rate between the two zones in which different environments prevail, without interrupting the confinement of the said zones, is absolutely not satisfactorily solved by any one of the known devices, particularly when there is a risk of cross-contamination between the two zones. Furthermore, the technique of the curtain of air does not provide a proper solution to the problems, particularly the transfer-of-contamination problems associated with there possibly being a raised pressure in one of the zones which are to be separated.

Finally, document DE 1 087 787 discloses an airlock for separating first and second zones in which different environments prevail.

According to this document, this airlock is in the form of a passage bounded on the outside by the floor, a side wall and a horizontal ceiling. A protective flow is blown into this passage through slits supplied with air and distributed along the side wall, the floor and the horizontal ceiling. This protective flow is blown such that as it leaves the passage, it fills the entire cross section of the said passage.

It is then taken up by a suction device into a discharge pipe. The protective flow is at a high enough speed that it forms a barrier against an air stream directed through the passage in the opposite direction to it.

Such an airlock is not, however, very effective, because the protective flow thus created is not strong enough to form an impassable barrier.

In order to alleviate the drawbacks of the aforementioned state of the art, the invention proposes a novel improved device for separating first and second zones in which different environments prevail, which is highly effective and allows an impassable barrier to be created between the two zones, resisting the stream of air so as, in particular, to block the passage of contamination from one zone to the other while at the same time allowing objects or products to be transferred at high speed between the two zones without this interrupting their confinement, including instances in which there is a risk of cross contamination between these zones.

More specifically, according to the invention, the separation device is characterized in that it comprises:

a buffer zone which extends along a longitudinal axis X between the first and second zones and which communicates via an inlet with the first zone and via an outlet with the second zone and which is delimited by two vertical walls facing each other, which extend along the axis X, comprising perforated sheets, blowing means capable of blowing clean, sterile air into the said buffer zone through the said perforations in the said vertical walls, and air-injection means opening in the region of the inlet of the buffer zone and capable of injecting, on each side of the said longitudinal axis X, toward the outlet of the said buffer zone, two jets of clean air at high speed in oblique directions with respect to the axis X, which cross each other in a region located between the inlet and the central region of the said buffer zone, so as to form an impassable barrier which separates the said first zone from the said second zone.

Thus, in the separation device according to the present invention, a pressure difference is created between the inlet and the outlet of the buffer zone, and this pressure difference is able to withstand the stream of air and block the passage of any contamination from one zone to the other by way of the impassable barrier. This impassable barrier according to the invention is created in a first part of the buffer zone lying between its inlet and its central region. The barrier created in the separation device according to the invention may advantageously also constitute a brake between a zone at a raised pressure and the outside, so as to restrict the flow rate of air leaving the zone at a raised pressure toward the outside.

According to a preferred embodiment of the separation device according to the invention, the longitudinal axis X of the buffer zone is a horizontal axis, and the air-injection means comprise vertical slits made in the internal faces of the vertical walls delimiting the said buffer zone, the said slits being positioned near the inlet of the buffer zone on each side of the said longitudinal axis X and facing each other, and supplied with clean air.

In particular, there may be four vertical slits on each of the vertical internal faces, facing each other, of the buffer zone.

It should be noted that the ability of the separation device according to the invention, and more particularly of the buffer zone of this device, to withstand pressure, is roughly proportional to the flow rate of air blown through the said slits or alternatively to the square of the speed at which the clean air injected through the said slits is blown.

It is thus possible to increase the pressure resistance of the said device by multiplying the number of slits or by increasing the speed of the air blown through the said slits.

It should be noted that the flow rate of air blown through the said slits and the number of slits provided at the inlet to the buffer zone depend on its size and, in particular, on its cross section.

According to an advantageous embodiment of the separating device according to the present invention, the buffer zone is delimited by the two vertical walls facing each other, a bottom and a top which form a right-angled parallelepiped, the cross-sectional area of which is of the order of 0.2 $m^2$, and the air-injection means inject jets of clean air through the said slits at a flow rate of the order of 400 $m^3/h$, so that the impassable barrier formed inside the said buffer zone is capable of withstanding a pressure difference between the outlet and the inlet of the buffer zone of between 5 and 10 pascals.

When a pressure difference of the order of 20 pascals is imposed between the inlet and the outlet of the buffer zone, the impassable barrier created inside the said buffer zone allows the amount of contamination transferred between the inlet and the outlet thereof to be reduced by a factor of 10.

As a preference, the ratio between the flow rate of clean, sterile air injected through the said perforations and the flow rate of the jets of clean air injected at the inlet of the said buffer zone toward its outlet, is roughly between 0.5 and 1.

The description which will follow, with reference to the appended drawings which are given by way of nonlimiting examples, will make it easy to understand what the invention consists of and how it may be achieved.

Figure 2:
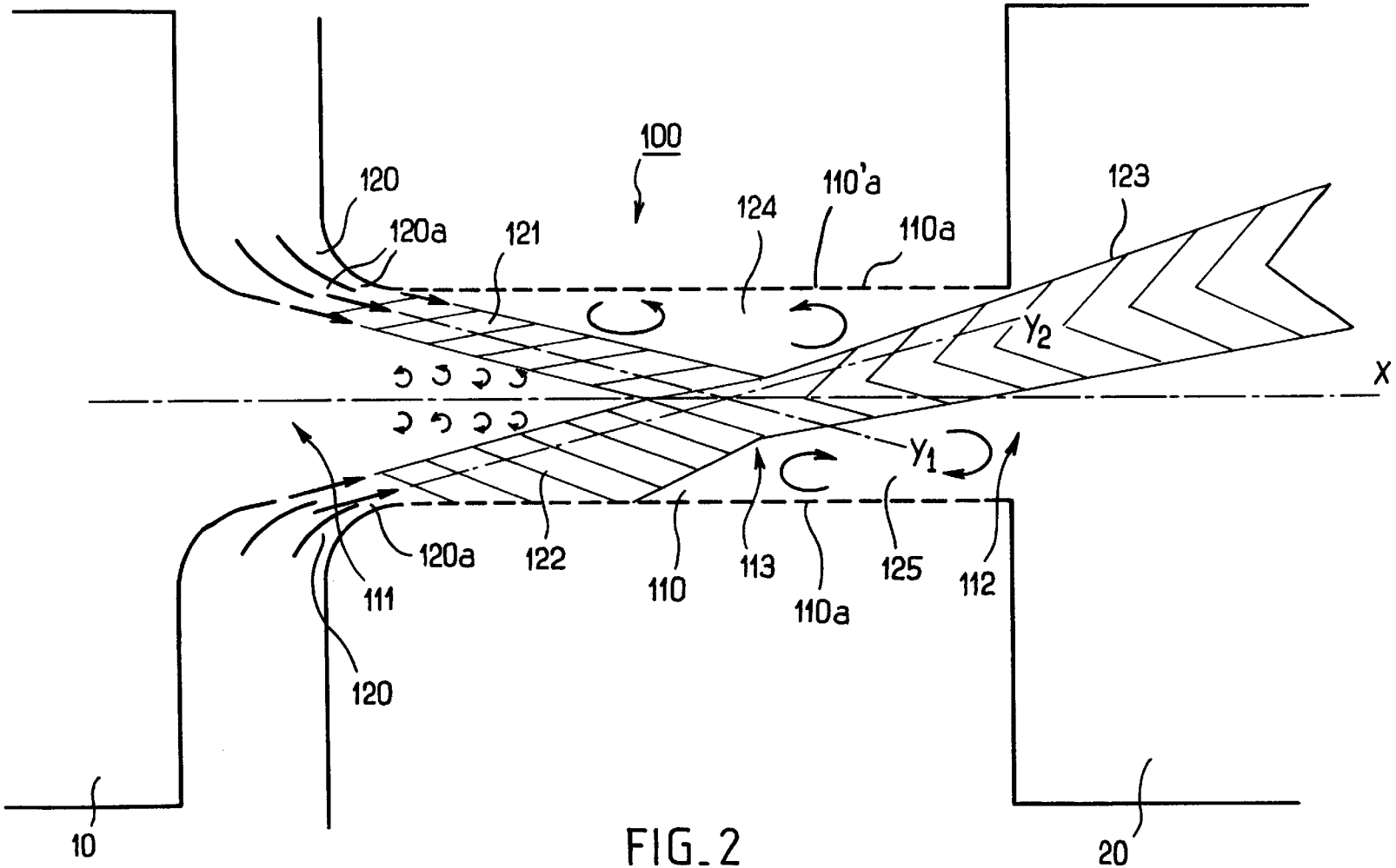
Figure 3:
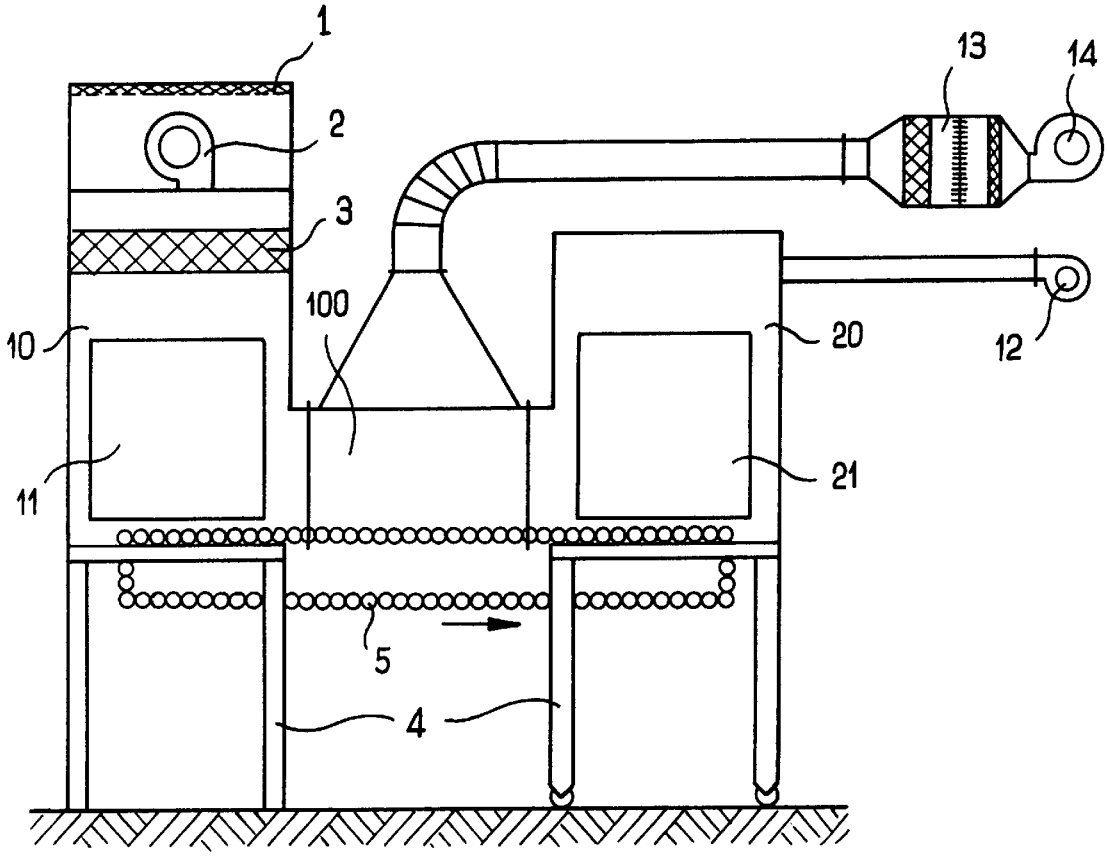
Figure 4:
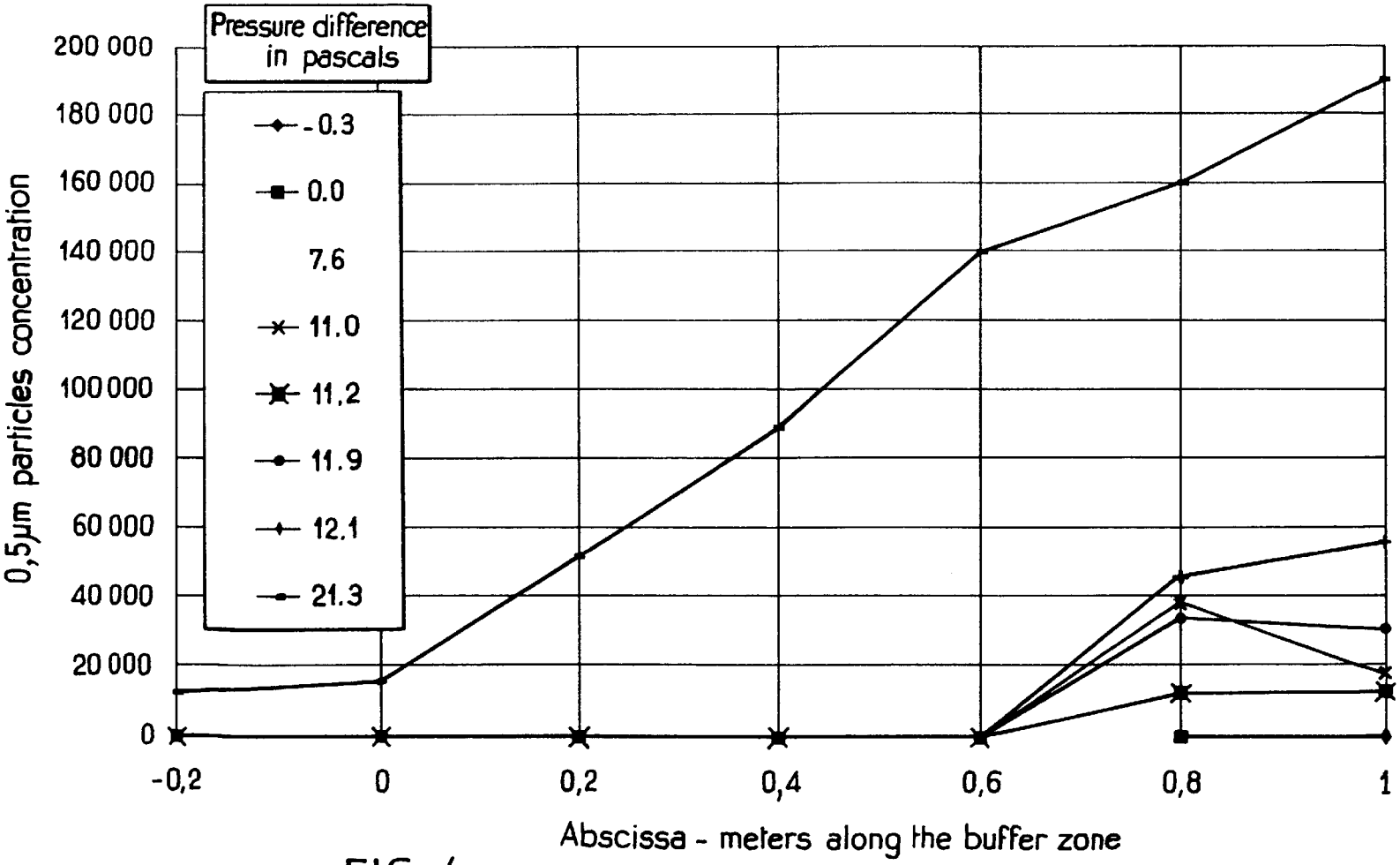

In the appended drawings:

FIG. 1 is a diagrammatic perspective view of the separation device according to the invention, FIG. 2 is a diagrammatic view in longitudinal section of the device of FIG. 1, positioned between a first zone and a second zone, FIG. 3 is a diagrammatic face-on view of a rig for testing the separation device of the invention, FIG. 4 depicts curves of the results of tests performed on the test rig of FIG. 3.

FIGS. 1 and 2 depict a device 100 for separating first and second zones 10, 20 in which different environments prevail.

The first zone 10 is, in this instance, a zone that is to be protected, for example a clean zone in which the air is sterile and in which, in general, the prevailing pressure is a slightly raised pressure. The second zone 20 is, for example, a dirty zone at atmospheric pressure, in which the air is laden with contaminants.

It should be noted that in most real scenarios, it is the clean zone that is at a raised pressure compared with the dirty zone, but when there is no such raised pressure, it is possible that the dirty zone might temporarily find itself at a higher pressure, under the effect of drafts or disturbances created by production activities.

The separation device 100 depicted in FIGS. 1 and 2 in this instance comprises two vertical walls 110*a* facing each other, a top 110*c* and a bottom 110*b* which form a right-angled parallelepiped and between them delimit a buffer zone 110. This buffer zone 110 extends along a longitudinal axis X, horizontal in this instance, between the first and second zones 10, 20.

According to the embodiment depicted, the buffer zone 110 is about 0.8 m long and has a cross-sectional area of the order of 0.2 $m^2$.

The buffer zone 110 communicates, via an inlet 111, with the first zone 10 that is to be protected or confined and via an outlet 112 with the second zone 20. The areas of the inlet 111 and of the outlet 112 of the buffer zone 110 are identical and correspond to the cross-sectional area thereof.

Furthermore, the separation device 100 comprises air-injection means 120, 120*a* which open at the inlet 111 of the buffer zone 110 and which are capable of injecting on each side of the longitudinal axis X of the said buffer zone 110, toward its outlet 112, two jets 121, 122 of clean air at high speed in oblique directions Y1, Y2 with respect to the said axis X so that these two jets 121, 122 of clean air meet approximately in a central region 113 of the said buffer zone 110.

More specifically, the air-injection means comprise vertical slits 120*a*, in this case four vertical slits 120*a*, made in each of the internal faces of the vertical walls 110*a* delimiting the said buffer zone, positioned near the inlet 111, on each side of the said longitudinal axis X, facing each other and directed toward the said buffer zone 110. The slits 120*a* are supplied with clean air via pipes 120 connected to sterile clean air inlets 101 provided on the upper part of the vertical walls 110*a* of the separation device 100.

According to the embodiment depicted, the flow rate of air injected through the said slits 120*a* is of the order of 430 $m^3$/h, which corresponds to a speed of delivery to the buffer zone of 0.7 m/s.

FIG. 2 more specifically shows the pneumatic operation of the separation device 100.

As can be seen from this figure, two flat jets 121, 122 of clean air are injected at high speed through the vertical slits 120*a* made in each of the internal faces of the vertical walls 110*a* of the separation device 100, in oblique directions Y1, Y2 with respect to the longitudinal axis X of the buffer zone 110.

These two flat jets 121, 122 of clean air meet in a region that lies between the inlet 111 and the central region 113 of the buffer zone 110, in this case this region being more particularly the central region 113, and form an impassable barrier which separates the said first zone 110 from the second zone 20. The jet 123 of air formed by the confluence of the two oblique jets 121, 122 enters the second zone 20 through the outlet 112 of the buffer zone.

This jet 123 of air cannot, in a stable manner, remain in the middle of the buffer zone 110 and shifts sideways to attach to one of the two vertical walls 110*a* of the separation device 110, according to classical jet behavior. This phenomenon of the jet 123 of air attaching to one of the walls 110*a* of the separation device 100 creates two zones 124, 125 in which air from the second zone 20 recirculates, one of the recirculation zones 124 being closed by the jet 123 of clean air, the other recirculation zone 125 being open, and communicating with the second zone 20.

As described in greater detail later on, tests performed on a test rig depicted in FIG. 3 which incorporates the separation device 100, have demonstrated that the barrier created inside the separation device as depicted in FIGS. 1 and 2, was capable of withstanding a pressure difference of between about 5 and 10 pascals, for a flow rate of air injected into the slits of the order of 400 $m^3$/h, preferably 430 $m^3$/h, the cross-sectional area of the buffer zone being of the order of 0.2 $m^2$ and preferably equal to 0.17 $m^2$. This flow rate of injected air corresponds to a speed of delivery into the buffer zone 110 of the order of 0.7 m/s.

Of course, it is possible to increase the pressure resistance of the separation device by increasing the number of slits on each internal face of each vertical wall or by increasing the speed of the clean air blown through the said slits. The ability of the separation device to withstand pressure is approximately proportional to the flow rate of blown air or to the square of the speed at which the air is blown through the slits.

According to one characteristic of the separation device 100 depicted in FIGS. 1 and 2, the vertical walls 110*a* facing each other comprise perforated sheets supplied by means for blowing in clean, sterile air, so as to blow clean air into the said buffer zone 110 through the said perforations 110'*a*. The sterile air is supplied to the said perforations 110*a*' via air inlets 101 provided on the upper part of the vertical walls 110. It should be emphasized that, in this instance, the air inlets 101 supplying the sterile air to the said perforations, are distinct from those supplying the air pipes 120 leading to the slits, and vice versa. This is because the flow rate of clean, sterile air injected through the perforations 110*a*' differs from that of the jets 121, 122 of air injected into the buffer zone 110 via the slits 120*a*, the ratio of the two flow rates being between about 0.5 and 1, preferably being equal to 0.5. What this means is that for a flow rate of the order of 400 $m^3$/h for the jets 121, 122 of clean air, the flow rate of the clean air injected through the perforations 110*a*' is of the order of 200 $m^3$/h.

This clean air reaches the recirculation zones 124, 125 directly, and this makes it possible to increase the effectiveness of the impassable barrier created by the flat jets 121, 122 of clean air in the central zone of the buffer zone 1.

FIG. 3 diagrammatically depicts the set-up of a test rig for testing the separation device 100.

As can be seen in FIG. 3, upstream of the separation device 100 there is a clean room 10, equipped with a ceiling-mounted absolute filter 3 surmounted by a fan 2 and a prefilter 1. This ceiling-mounted absolute filter 3 allows a vertical one-way stream of air toward the floor of the clean room, to be created in this room.

The floor of this clean room 10 consists of removable perforated sheets. This makes it possible to vary its resistance to the passage of air.

Downstream of the separation device 100 is a dirty room 20 supplied with contaminated air by a ceiling-mounted fan 12 so that the dirty room may possibly be placed under a raised pressure, the ceiling-mounted fan of course having no filter.

The floor of the dirty room also consists of perforated sheets.

As can be seen in FIG. 3, there are windows 11 and 21 for watching what takes place inside the rooms 10 and 20 respectively. There is also a filtration box 13 associated with a fan 14 which allows the inlets 101 (see FIG. 1) on the vertical walls 110*a* of the suction device 100 to be supplied, so that clean air can be injected via the pipes 120 of the injection means through the slits 120*a* into the buffer zone 110 of the separation device 100.

A conveyor 5, the geometry of which is adapted to suit that of the buffer zone 110 passes through the said buffer zone 110 of the suction device 100 to transfer products or objects at a high rate from the clean room 10 to the dirty room 20, and vice versa.

The assembly is mounted on supports 4 placed on the floor of the test room.

By altering the air flow rates created by the fans 2 and 12, it is then possible to alter the pressure in each of the rooms and thus create a pressure difference at the boundaries of the separation device 100.

The purpose of the tests performed on this test rig was to verify that the barrier created in the separation device 100 according to the invention was indeed impassable to contamination which could be conveyed between the two rooms or zones when transferring products or objects from one zone to the other using the conveyor 5 and that this impassable barrier was capable of withstanding a pressure difference created between the two rooms, with possibly a raised pressure in the dirty room 20.

Of course, in most real scenarios it is the clean room which is at a raised pressure, but when there is no such raised pressure, it may be that the dirty room is temporarily at a higher pressure, under the effect of drafts or disturbances created for example by production activities.

Because of this, the separation device according to the invention has to be capable of withstanding such a reverse raised pressure.

During testing, measurements of the particles meter were taken using an isokinetic sampling probe.

The probe was moved axially along the buffer zone starting from the clean zone located at abscissa X=0 (the inlet of the buffer zone) up to the dirty zone located at abscissa X=0.8 m (the outlet of the buffer zone).

The operating conditions of the suction device 100 in the test rig as depicted in FIG. 3, were as follows:

the speed of the air leaving the slits was 7 m/s, the flow rate of air leaving the slits was of the order of 432 $m^3/h$, there is no supply to the perforated vertical walls.

The results obtained during these tests are shown in FIG. 4, which depicts various curves for various values of pressure difference between the inlet and the outlet of the buffer region of the separation device 100, the dirty room 20 being at a raised pressure.

As shown by the various curves depicted in FIG. 4, the impassable barrier created in the central part (located at approximately abscissa 0.4 m) of the buffer zone of the separation device according to the invention, is capable of withstanding a pressure difference of the order of 10 pascals, which is highly attractive.

When the pressure difference between the inlet and the outlet of the buffer zone is 21 pascals, it can be verified that the separation device according to the invention allows the level of contamination transferred between the dirty room and the clean room to be reduced by a factor of 10.

The measurements, the results of which are depicted in FIG. 4, were taken along the longitudinal axis X of the buffer zone of the said separation device.

However, it was checked that the results obtained do not depend on the fact that measurements were made along the longitudinal axis X of the buffer zone.

For example, for a pressure difference of 10 pascals, it was checked that the measurement results were identical to those taken along the longitudinal axis X of the buffer zone 110 when these measurements were taken at other points (not on the X-axis) of the cross section of this buffer zone.

The present invention is not in any way restricted to the embodiments described and depicted, and the person skilled in the art will be capable of varying it in any way which remains true to its spirit.

What is claimed is:

1. Device (100) for separating first and second zones (10, 20) in which different environments prevail, characterized in that it comprises:

a buffer zone (110) which extends along a longitudinal axis X between the first and second zones (10, 20) and which communicates via an inlet (111) with the first zone (10) and via an outlet (112) with the second zone (20) and which is delimited by two vertical walls **(110*a*) facing each other, which extend along the axis X, comprising perforated sheets, blowing means capable of blowing clean, sterile air into the said buffer zone (110) through the said perforations (110*a*') in the said vertical walls (110*a*), and air-injection means (120, 120*a*) opening in the region of the inlet (111) of the buffer zone (110) and capable of injecting, on each side of the said longitudinal axis X, toward the outlet (112) of the said buffer zone (110), two jets (121, 122) of clean air at high speed in oblique directions (Y1, Y2) with respect to the axis X, which cross each other in a region located between the inlet (111) and the central region (113) of the said buffer zone (110), so as to form an impassable barrier which separates the said first zone (10) from the second zone (20)**.

2. Device according to claim 1, characterized in that the longitudinal axis X of the said buffer zone (110) is a horizontal axis, and the air-injection means comprise vertical slits **(120*a*) made in the internal faces of the vertical walls (110*a*) delimiting the said buffer zone (110), the said slits (120*a*) being positioned near the inlet (110) of the buffer zone (110)** on each side of the said longitudinal axis X and facing each other, and supplied with clean air.

3. Device according to claim 2, characterized in that there are four vertical slits **(120*a*) on each of the said vertical internal faces facing each other of the said buffer zone (110)**.

4. Device according to claim 3, characterized in that the buffer zone (110) is delimited by the two vertical walls facing each other, a bottom and a top which form a right-angled parallelepiped, the cross-sectional area of which is of the order of 0.2 $m^2$, and in that the air-injection means **(120, 120*a*) inject jets of clean air through the said slits (120*a*) at a flow rate of the order of 400 $m^3/h$, so that the impassable barrier formed inside the said buffer zone (110) is capable of withstanding a pressure difference between the outlet (111) and the inlet (112) of the buffer zone (110)** of between 5 and 10 pascals.

5. Device according to claim 1, characterized in that the ratio between the flow rate of clean, sterile air injected through said perforations **(110*a*') and the flow rate of the jets (121,122) of clean air injected at the inlet (111) of said buffer zone (110) toward its cutlet (112)**, is roughly between 0.5 and 1.

* * * * *